United States Patent [19]

Cummings

[11] Patent Number: 4,799,171

[45] Date of Patent: Jan. 17, 1989

[54] TALK BACK DOLL

[75] Inventor: Charles A. Cummings, Cincinnati, Ohio

[73] Assignee: Kenner Parker Toys Inc., Beverly, Mass.

[21] Appl. No.: 553,922

[22] Filed: Nov. 21, 1983

Related U.S. Application Data

[63] Continuation-in-part of Ser. No. 506,132, Jun. 20, 1983, abandoned.

[51] Int. Cl.[4] ..... G10L 5/00

[52] U.S. Cl. ..... 364/513.5; 381/51

[58] Field of Search ..... 364/513, 513.5; 381/51-53, 43

[56] References Cited

U.S. PATENT DOCUMENTS 4,221,927 9/1980 Dankman et al. ..... 381/46

4,318,245 3/1982 Stowell et al. ..... 381/51

OTHER PUBLICATIONS

Flanagan, F., "Computers that Talk and Listen: Man-Machine Communication by Voice," proceeding IEEE, vol. 64, No. 4, 4/76, pp. 405-415.

*Primary Examiner*—Emanuel S. Kemeny

*Attorney, Agent, or Firm*—L. MeRoy Lillehaugen; Stuart R. Peterson

[57] ABSTRACT

A toy figure in the form of a doll contains therein an acceleration switch which, when closed by moving the doll, momentarily connects a battery to a microcomputer. By means of a microphone and a zero-crossing counting technique, the microcomputer, although the voice signal constituting the input thereto is not truly representative of the particular words being spoken by the child, generally recognizes several basic words. A voice synthesizer has a number of words stored therein, the microcomputer forwarding various digital codes calling for certain words to be constructed and emitted via a small speaker in the doll's body. Several time restraints are utilized to inactivate the circuitry and to elicit voice responses. The doll recognizes words sounding like Yes, No, or What, and in response randomly selects from three corresponding memory banks a response statement.

54 Claims, 4 Drawing Sheets

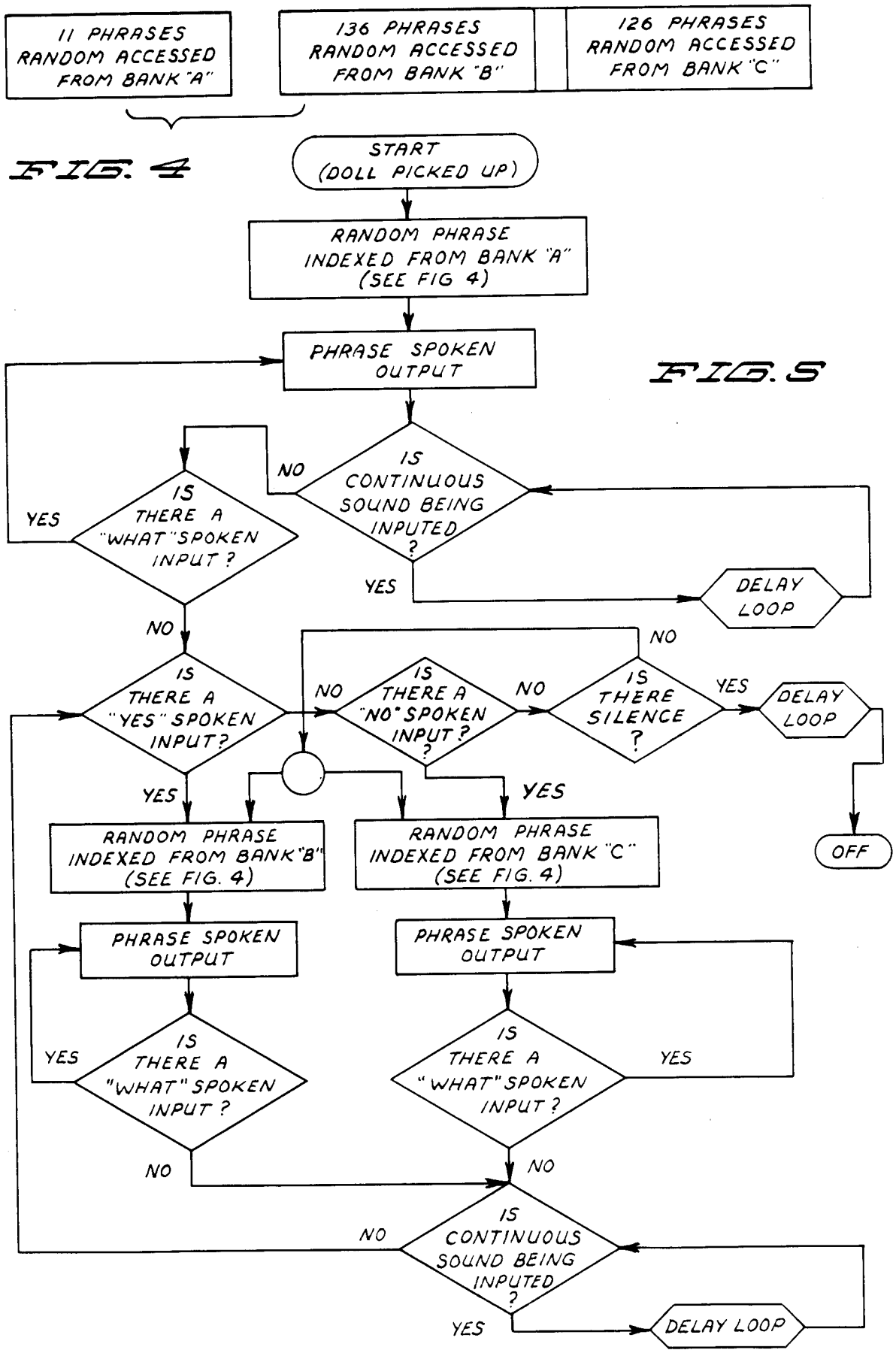
11 PHRASES RANDOM ACCESSED FROM BANK "A"
136 PHRASES RANDOM ACCESSED FROM BANK "B"
126 PHRASES RANDOM ACCESSED FROM BANK "C"
FIG. 4
START (DOLL PICKED UP)
RANDOM PHRASE INDEXED FROM BANK "A" (SEE FIG 4)
PHRASE SPOKEN OUTPUT
FIG. 5
IS CONTINUOUS SOUND BEING INPUTED ?
NO
YES
IS THERE A "WHAT" SPOKEN INPUT ?
YES
DELAY LOOP
NO
IS THERE A "YES" SPOKEN INPUT ?
NO
IS THERE A "NO" SPOKEN INPUT ?
NO
IS THERE SILENCE ?
NO
YES
DELAY LOOP
OFF
YES
YES
RANDOM PHRASE INDEXED FROM BANK "B" (SEE FIG. 4)
RANDOM PHRASE INDEXED FROM BANK "C" (SEE FIG. 4)
PHRASE SPOKEN OUTPUT
PHRASE SPOKEN OUTPUT
YES
IS THERE A "WHAT" SPOKEN INPUT ?
IS THERE A "WHAT" SPOKEN INPUT ?
YES
NO
NO
NO
IS CONTINUOUS SOUND BEING INPUTED ?
YES
DELAY LOOP

TALK BACK DOLL

CROSS-REFERENCE TO RELATED APPLICATION

This is a continuation-in-part of Ser. No. 506,132 filed June 20, 1983 for "TALK BACK DOLL", now abandoned.

BACKGROUND OF THE INVENTION

1. Field of the Invention

This invention relates generally to toys of the talking variety, and pertains more particularly to a doll having listening and talking capabilities, thereby enabling a simulated two-way conversation to be conducted between the child and the doll.

2. Description of the Prior Art

Talking devices are rapidly becoming quite common. Some are triggered into operation by the generation of a warning signal. Typical of such devices is the vehicle-associated system described in U.S. Pat. No. 4,310,825 granted to Tsunoda et al on Jan. 12, 1982 for "VOICE WARNING SYSTEM FOR AN AUTOMOTIVE VEHICLE" and U.S. Pat. No. 4,343,990 granted to Shigeki Ueda for "HEATING APPARATUS SAFETY DEVICE USING VOICE SYNTHESIZER."

While the above two patents deal with only voice synthesizing, patents have been granted where voice recognition and synthesis are employed. Such patents include U.S. Pat. No. 3,356,836 granted on Dec. 5, 1967 to Walter h. Stenby for "SPEECH CONTROLLED ANNOUNCING CALCULATOR" and U.S. Pat. No. 4,305,313 issued on Dec. 8, 1981 to Robert M. Best for "DIALOG BETWEEN TV MOVIES AND HUMAN VIEWERS."

Voice simulation has been embodied in toys. Two patents involving talking toys are U.S. Pat. No. 4,221,927 issued on Sept. 9, 1980 to Dankman et al for "VOICE RESPONSIVE 'TALKING' TOY" and U.S. Pat. No. 4,318,245 issued on Mar. 9, 1982 to Stowell et al for "VOCALIZING APPARATUS." Even though unique and intriguing features are incorporated into each of the patented constructions, nonetheless each lacks a certain amount of realism. For instance, in the Dankman et al patent, there is a random production of what amounts to sounds constituting a strange language, the random production of the language being triggered by a voice input. The Dankman et al patent, while novel, could hardly be considered to provide a dialog. In the Stowell patent, there is no dialog whatsoever between the child and the doll, the sounds uttered by the doll being dependent upon the closure of a gravity switch and the subsequent verbalization of different types of messages depending upon movement of the doll and the time of such movement.

SUMMARY OF THE INVENTION

A general object of my invention is to provide a toy figure, more specifically, a doll which possesses more realism than toys of this character have had in the past. More specifically, it is an aim of the invention to provide a toy figure in the form of a doll that will carry on a conversation that the child regards as being meaningful.

A more specific object of the invention is to provide a doll that rmains silent until picked up or moved.

Whereas the doll remains silent until picked up when practicing the teachings of my invention, another object is to keep the doll awake or alert, so to speak, as long as it hears someone talking.

Still further, an object of the invention is to provide a toy figure, such as a doll, that when first picked up is conditioned for sounds from the child, yet if the doll hears nothing within a predetermined interval, then the doll itself initiates the conversation, the dialog continuing if the child speaks because the doll is designed to listen to what the child says, responding to different basic sounds that the child may utter.

In view of the above objects, it can be stated more comprehensively that a more general object of the invention is to turn on a microcomputer constituting the doll's brain, doing so with hardware, and to thereafter turn off the microcomputer, doing so with software, when certain conditions have not occurred or have ceased to occur.

The invention also has for an object, in addition to the relatively general object that the doll's microcomputer will be turned on with hardware and turned off with software, that there be no visible switch, the invention providing for the inclusion of an acceleration sensitive switch that need make only momentary contact to energize the microcomputer. It is after that that the electrical circuitry contained within the doll remains connected to the doll's battery as long as there is either movement of the doll or voice input to the doll during a predetermined interval of time.

Another specific object is to provide a talking doll that will be operable independently of any positon in which the doll is placed. In this regard, the doll does not have to be moved from, say, a prone position into a sitting position in order to energize its microcomputer. Instead, it is the initial and instantaneous closing of the acceleration switch when the doll is moved from any position into any other position. Consequently, the need for the child to maintain the doll in any given position is obviated, thereby imparting a greater amount of realism to my talk back doll.

Another object is to provide a battery-operated doll that will not require any power from the battery until the doll has been moved, and which will automatically turn itself off if not moved or spoken to within a predetermined period.

Yet another object of the invention is to provide a doll that once it has been picked up will conduct a back and forth sequence of spoken words in general accordance with what the child says to the doll. Additionally, it is an aim of the invention to provide combinations of random statements so that each time the doll is picked up the child can, within reasonable limits, expect a different reply to a given question. Stated somewhat differently, the response made by the doll differs each time the doll is picked up, although over a period of time the same response phrases will be repeated. The randomness of the replies enhance the realism of the doll because the child does not immediately hear the same spoken words from the doll, there being a considerable variation in the content of the responses.

Further, the invention has for a relatively specific object the provision of a doll that will respond to several basic sounds, such as those resembling "yes", "no" and "what". More specifically, phrases in one bank of a ROM memory are calld out when the doll is initially moved by reason of the closing of an acceleration sensitive switch that energizes or activates a microcomputer.

It is at this time that there is a random accessing of one of eleven phrases stored in the ROM bank containing these phrases. Thereafter, the doll is responsive to sound or voice input. In this regard, a "yes" calls out a phrase randomly from a second bank of the ROM from a much larger number of phrases and a "no" elicits a phrase randomly selected from a third ROM bank in the microcomputer which also contains a relatively large number of stored phrases. A sound resembling "what" said to the doll after it has just uttered a phrase requires that that phrase be repeated. It is within the contemplation of the invention that any other voice input besides the equivalent of "yes", "no" or "what" will randomly call out a phrase from the second and third banks of the ROM memory.

Still another object of the invention is to provide a doll that will not speak as long as it is being spoken to. Thus, it is within the contemplation of my invention to have the doll remain silent until spoken or sung to. Consequently, the doll is subservient to the child as far as its listening and speaking habits are concerned.

The invention has for still another object the provision of electronic circuitry that will not only be simple, being devoid of any moving parts with the exception of the acceleration switch, but will not be apt to get out of order readily.

Also, it is within the purview of the invention to provide a doll that can be manufactured and fabricated at a relatively low cost, thereby encouraging its widespread purchase and use.

Another object is to provide a doll, while having listening and speaking capabilities, that for all intents and purposes looks like any other doll. It is also within the comprehension of the invention to provide a toy figure that can assume a variety of animal configurations, any of which with whom a child would wish to converse, inasmuch as the circuitry required can be quite compact and totally concealed within the figure's body. In this regard, it is to be recognized that no external switch is required for conditioning the figure, irrespective of its form, for operation.

Briefly, my invention envisages a toy figure, more specifically, a conventionally appearing doll, that has concealed therein an acceleration switch that normally disconnects the circuitry from the battery which is also contained within the doll's body. Whenever the doll is picked up or moved, the acceleration responsive switch monentarily completes an electric circuit connecting the battery to the microcomputer. The microcomputer, although the voice signal constituting the input thereto is not truly representative of the particular words being spoken by the child, generally recognizes the words "yes", "no", and "what", employing a zero-crossing analysis in doing so. In this regard, the technique involves the dividing of the speech signal into two frequency bands. The first band includes frequencies from 300 to 1,000 Hz and the second band including frequencies from 1,000 to 6,000 Hz. Each band of zero-crossings is detected and integrated through a low-pass filter. In this way, very little ROM memory is needed to change the basic language information in the input signal to digital data, yet retaining a sufficient number of the major formants of speech so that the type of talk that a small child expects from a doll can be realized.

Before any sound-derived signal is received from the microphone by the microcomputer, it is to be noted that as soon as the acceleration switch is instantaneously closed, the microcomputer randomly will read from its first bank of ROM memory any of eleven different phrases of from one to four words. The microcomputer will remain on for fifteen seconds, but after that time period if there is no sound, or the acceleration switch is not again closed, the voice system contained within the doll is electronically shut off. If there is a sound input, either a positive "yes", a negative "no", or sound of a general character, the microcomputer will call upon the appropriate bank for the digital data stored therein representative of preselected pertinent phrases.

If a "yes", "no", or general statement is directly followed by continuous conversation, either of a talking or singing character, the phrase call out will be delayed until the sound input stops. Thus, the doll will refrain from speaking while being spoken to. After the doll speaks and it is asked "what", the last phrase will be repeated. Any statement directed to the doll other than "what" will call for a randomly selected phrase from either the second or third bank of the ROM memory which randomly selected phrase is to be spoken by the doll. It is to be noted that phrases from the first bank of ROM memory are only spoken by the doll when the doll is first picked up.

The electronic circuitry includes a voice synthesizer unit which stores a given number of words that may be read out in any order. This is accomplished by a string of digital codes, each code digitally calling for a particular word, which codes are sequentially sent over six data lines connected between the microcomputer and the synthesizer chip. Consequently, the microcomputer initially calls for a sequence of any number of words or phrases. Once the synthesizer receives the string of digital codes, then it outputs analog signals to a microphone which cause the doll to evoke intelligible and responseful voice sounds derived from the ROM memory integral with the synthesizer chip and/or whatever external ROM memory may be required in order to provide a sufficient response vocabulary.

Hence, even though the voice signal constituting the input to the microcomputer is not truly representative of the particular words being spoken by the child, nonetheless the zero-crossing counting procedure incorporated into hardware architecture exemplifying my invention minimizes the amount of circuitry that need be contained in the microcomputer. In this way, a voice and listening interaction is provided between the child and her doll. By selecting short responses, that is, replies of a general character, the responses made as a result of the digital information contained in the ROM memory of the synthesizer will appear to be responsive to whatever question is directed to the doll by the child. Hence, a high degree of realism is provided in a doll having incorporated therein a two-way voice system embodying my inventive concepts therein.

BRIEF DESCRIPTION OF THE DRAWINGS

FIG. 4 is a memory map, the view graphically and diagrammatically illustrating the storage of various phrases in the ROM memory of the voice synthesizer unit, and FIG. 5 is a flow diagram illustrating a general sequence of programming steps utilized in the production of certain output statements in response to selected input statements.

DESCRIPTION OF THE PREFERRED EMBODIMENT

Figures 1, 2:
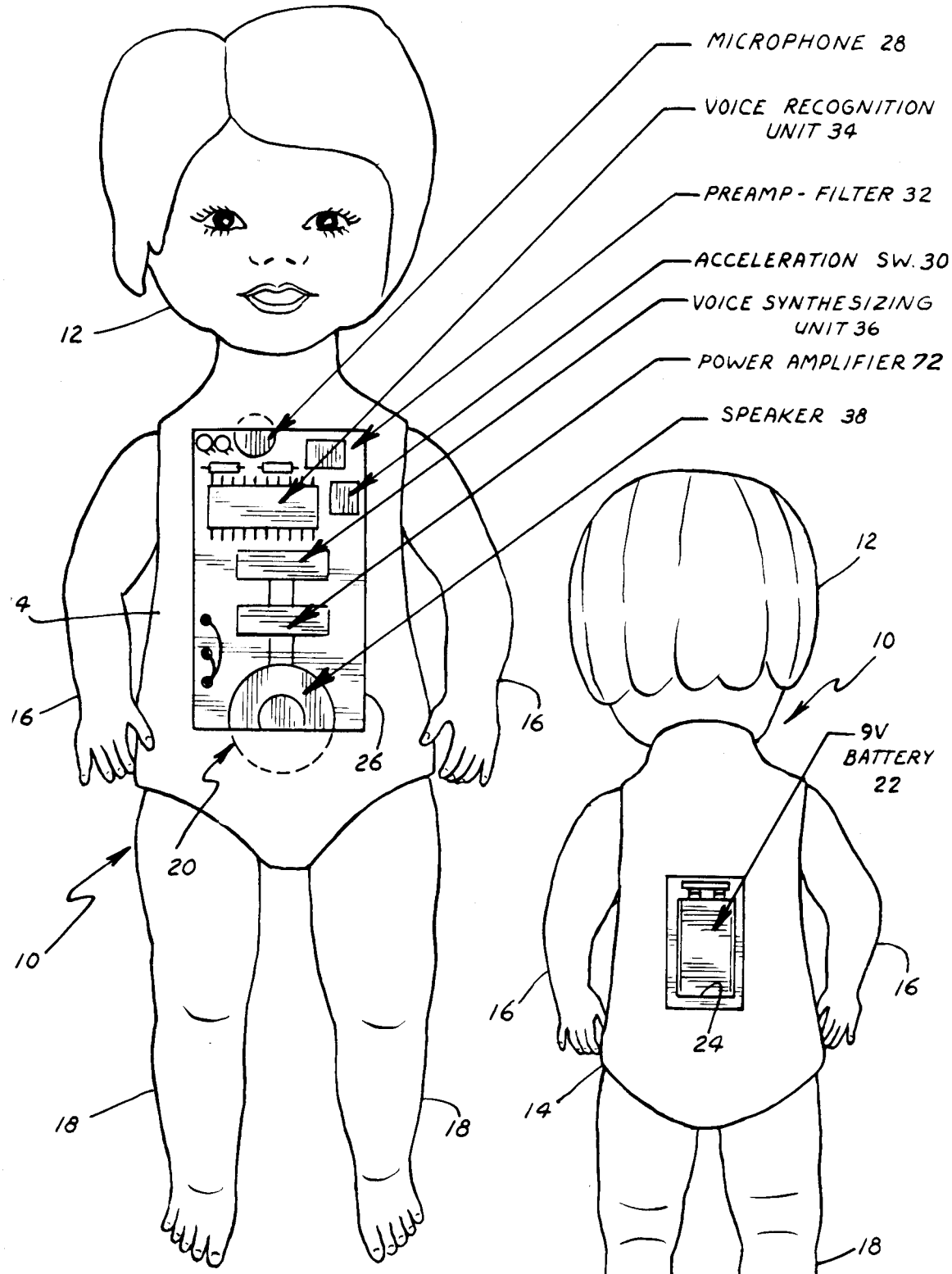
FIG. 1 is a front view of a doll containing therein electronic circuitry configured in accordance with my invention, a portion of the doll's body having been removed in order to expose to view the circuitry (not to scale) that would otherwise be concealed.
FIG. 2 is a rear view of the doll, the rear view being on a smaller scale and showing the battery that supplies power to the circuitry made visible in FIG. 1.

Referring now to FIGS. 1 and 2, it will be seen that a toy figure in the form of a doll denoted generally by the reference numeral 10 has been pictured. The doll 10 includes a head 12, a body 14, arms 16 and legs 18. Outwardly the doll 10 has a conventional appearance, as is evident from FIGS. 1 and 2.

The circuitry or system illustrating my invention has been indicated generally by the reference numeral 20, a portion of the body 14 having been broken away in FIG. 1 to show the entire circuit 20. The power supply for the circuit 20 is in the form of a nine volt battery 22 contained in a recess 24 in the rear of the doll's body 14, as can be understood from FIG. 2. All of the components constituting the circuit 20 are mounted on a board 26 which board 26 is suitably anchored within the body 14. In this regard, the circuit 20 basically includes a microphone 28, a normally open acceleration switch 30, a preamp-filter unit 32, a voice recognition unit 34, a voice synthesizing unit 36, and a speaker 38.

Referring now to the circuit or system 20 in detail, the microphone 28 is suggestively a condenser microphone into which a child speaks. As can be descerned from FIG. 3A, one side of the microphone 28 is grounded at 40 through a capacitor 42. More will be said presently concerning the manner in which the voice signals picked up by the microphone 28 are processed.

At this time, the construction of the acceleration switch 30 that has been selected will be described. It is important to recognize that this is not a switch 30 that is manipulated by the child. Instead, the function of the normally open switch 30 is to energize the various components 34, 36 and 38, doing so when a pair of cooperable electrical contacts 44, 46 contained within a tubular casing 48 are closed. Also within the casing 48 is a small metal ball 50 free to move in a tracked relationship, the casing 48 itself serving as a cage, so to speak. It is when the casing 48 is moved, being mounted on the board 26 which in turn is fixedly supported within the doll 10, that the ball 50 accelerates, striking the contact 44 which is in the form of a resilient leaf spring. The momentum of the ball 50 causes the spring contact 44 to flex so that it engages the contact 46, which is fixed, so as to complete a circuit from the battery 22 to the speech recognition unit 34.

The weight or mass of the ball 50, however, is not sufficient to deflect the spring contact 44 against the fixed contact 46 should the casing 48 be oriented vertically or at such an inclination that the ball 50 rolls against the spring contact 44. Thus, it is intended that the ball 50 be of a weight and size such as to not deflect the spring contact 44 even when the ball 50 is resting directly thereon. Stated somewhat differently, it is the momentum of the metal ball 50, preferably of steel, that causes contact 44 to engage the fixed contact 46, thus momentarily energizing the voice recognition unit 34.

Figure 3A:
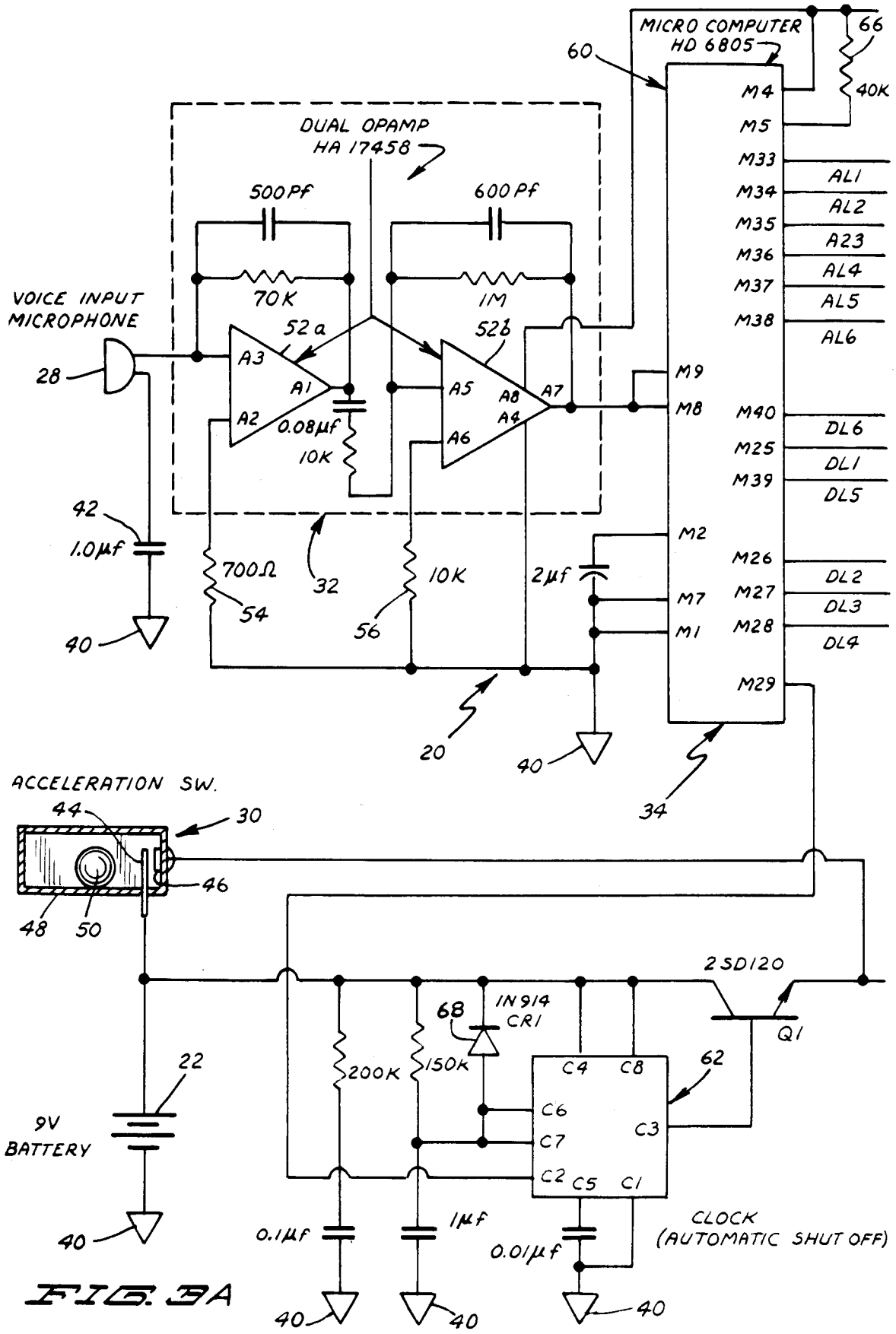
FIGS. 3A and 3B, when placed side-by-side, form a combined schematic and block diagram depicting the circuit components utilized in the circuitry shown in FIG. 1.

It is important to appreciate that the acceleration switch 30 is normally open, being closed only momentarily when the steel ball 50 is shifted sufficiently so as to strike the leaf spring contact 44, flexing it against the fixed contact 46. Normally, a single switch 30 of the general type just described will be ample. However, it will be understood that one or more additional switches connected in parallel with the switch 30 can be angularly, when employed, oriented with respect to the axis on which the switch 30 shown in FIGS. 1 and 3A is placed. When a multiple switch configuration is resorted to, it will be appreciated that if the ball 50 of any one of such additional switches 30 strikes its spring contact 44, causing that particular contact 44 to engage the contact 46 with which it coacts, a circuit will be completed between the battery 22 and the recognition unit 34. Turning now to a brief description of the preamp-filter unit 32, a suitable unit 32 can include an HA17458 operational amplifier manufactured by Hitachi, Ltd., Tokyo, Japan, which constitutes a dual operational amplifier comprised of first and second stages 52*a* and 52*b*, respectively. It will be helpful, it is believed, to use the same pin or terminal designations as used by the manufacturer to avoid duplication and possible confusion with other components comprising the circuit or system 20; the number of each pin, therefore, will be preceded by the letter "A."

Hence, the first stage 52*a* of the dual operational amplifier of the unit 32 has an output pin A1 and two input pins A2 and A3, whereas the second stage 52*b* has a Vss ground pin A4, two input pins A5 and A6, an output pin A7 and a Vcc plus voltage pin A8. The impedance values for the feedback paths appear on FIG. 3A, as do the values for the components coupling the output pin A1 of the first stage operational amplifier 52*a* to the input A5 of the second stage operational amplifier 52*b*. It will be discerned that the input pin A3 is connected directly to one side of the microphone 28, whereas the other input pin A2 is connected to ground 40 through a 700 ohm resistor 54. The other input pin A6, belonging to the second stage operational amplifier 52*b*, is connected to ground 40 through a 10K ohm resistor 56, as is the pin A4. The pin A8 is connected to the positive side of the battery 22 over an electrical path better reserved for suvbsequent description in that the same path energizes the voice recognition unit 34, the voice synthesizing unit 36, the speaker 38, as well as other components yet to be referred to.

It can be pointed out at this time, however, that a voice input to the microphone 28 is amplified by the unit 32, the amplified voice signal at the output pin A7 being saturated to the degree that the unit 32 functions somewhat like a switch, producing zero signal crossings at the output pin A7 which are further processed in a manner to be dealt with hereinafter. The output terminal or pin A7 of the operational amplifier 52*b* is connected to the recognition unit 34 which constitutes a microcomputer 60.

Although other microcomputers can be used, the microcomputer 60 that has been found satisfactory for the voice recognition unit 34 is the Hitachi HD6805U1 (or type HD6805V1 can be substituted therefor). This particular model HD6805U1 is an NMOS 8-bit microcomputer containing a CPU, on-chip clock, ROM, RAM, I/O and timer. Owing to the simplicity of processing the electrical signals forwarded from the microphone 28 when utilizing the teachings of my invention, a very simple microcomputer suffices, even the alluded to type having more hardware and software features than actually needed. Inasmuch as data sheets are available from Hitachi, Ltd. indicating the pin assignments for the designated microcomputer 60, as well as presenting an easily understood block diagram, it is not believed necessary to go into detail concerning the internal structure of this particular microcomputer.

Nonetheless, it will be helpful, it is thought, to utilize the same pin assignments as set forth n Hitachi's data sheets. Inasmuch as not all of the pins are utilized, only those pins actually made use of will be referred to, the number of each pin being preceded by the letter "M" in this instance.

It has already been mentioned that the function of the normally open acceleration switch 30 is to energize the voice recognition unit 34, more specifically to momentarily actuate or enable the microcomputer 60. This is done by having the contact 46 of the switch 30 connected directly to pin M4 of the microcomputer 60, thereby supplying Vcc power to the microcomputer 60 from the positive side of the battery 22, even though only momentarily by reason of the ball 50 merely rolling against the spring contact 44; nonetheless, this is sufficient to provide an output signal on pin M29. The pin M29, it can be explained, consitutes an I/O line for the B register within the microcomputer 60 and is connected directly to an external clock circuit 62, more specifically its trigger pin labeled C2. The external clock 62 can be type LM555, manufactured by Radio Corporation of America, New York, N.Y. In addition to the trigger pin C2, the clock 62 has a ground pin C1, an output pin C3, a reset pin C4, a control voltage pin C5, a Vcc threshold pin C6, a discharge pin C7, and a plus Vcc voltage supply pin C8. It should be understood that a microcomputer could be selected that would incorporate therein an internal clock, thereby eliminating the need for a separate part.

Figure 3B:
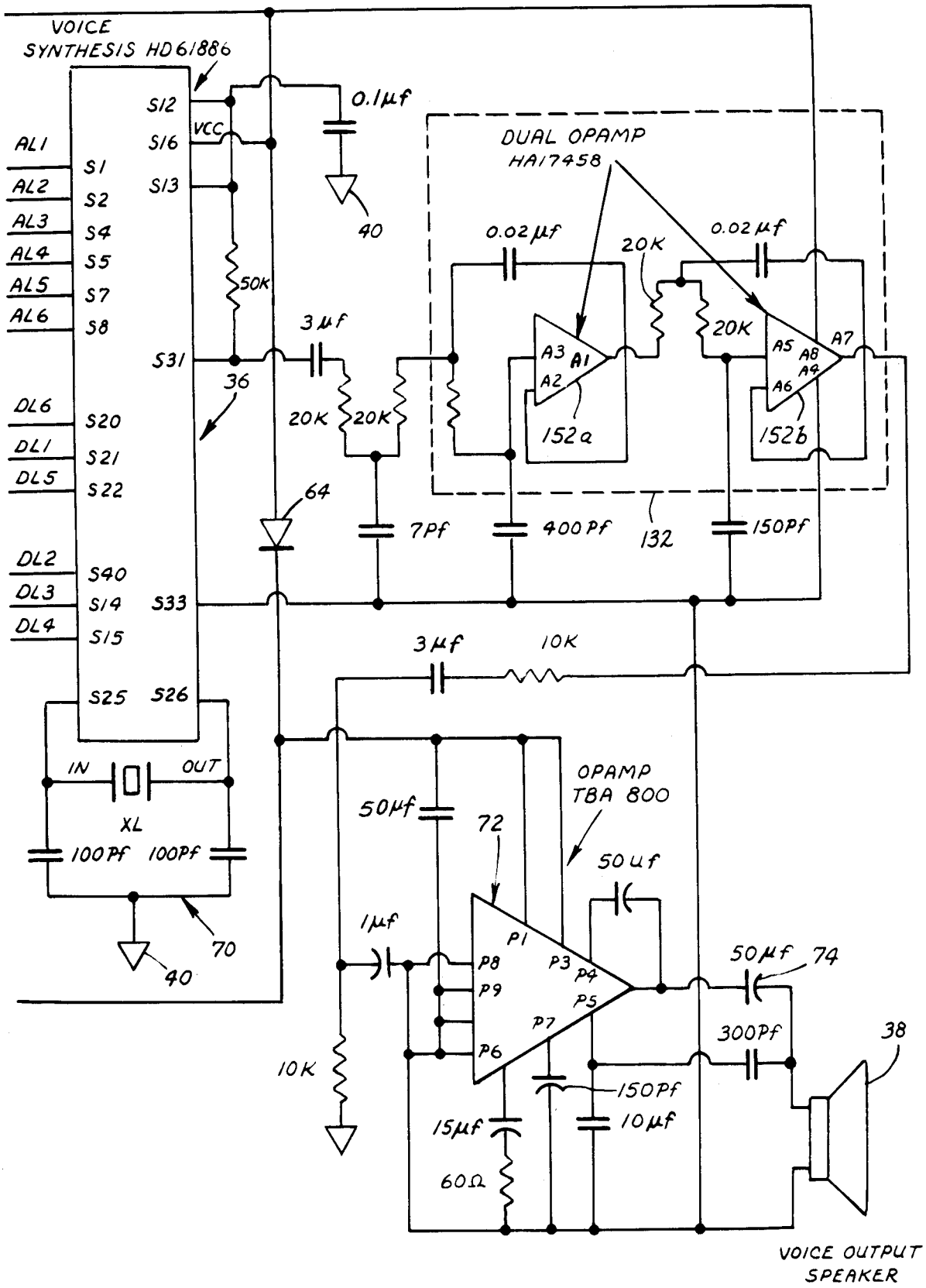

The output pin C3 is connected to the base of a transistor Q1, such as a 2SD120 NPN transistor, which has its collector connected to the positive side of the battery 22 and its emitter to the cathode of a diode 64 (FIG. 3B), the anode of the diode being connected to the Vcc supply voltage pin M4 of the microcomputer 60 and also through a 40K resistor 66 to the control input pin M5 belonging to the internal oscillator circuit contained in the microcomputer 60. The threshold pin C6 of the clock 62 is held at the proper Vcc supply voltage by means of an IN914 diode 68.

Consequently, when the switch 30 is momentarily closed, then the microcomputer 60 is turned on because the positive side of the battery 22 is then connected to the pin M4 through the diode 64, thereby supplying power to the circuit and triggering the clock 62 into operation in that the resulting output signal on pin M29 (pin M29 being connected to pin C2 of the clock 62) starts the clock 62. The clock 62 continues to generate a stream of timing pulses as long as there is a voice input (or other appropriate sound) to the microphone 28 occurring within fifteen second intervals; if there is no voice input for fifteen seconds, the clock 62 stops.

It should be obvious from the foregoing that the transistor Q1 functions as a switch, being conductive or closed as long as there is an output voltage on the pin C3 to apply a biasing potential to the base of the transistor Q1. Without a potential applied to the base of the transistor Q1, the transistor Q1 becomes nonconductive or open, thereby removing the Vcc supply power from the pin M4. Power is also removed from the operational amplifier **52*b* in that its pin A8, as is pin M4, is connected through the diode 64 and the collector-emitter circuit of the transistor Q1 to the battery 22**.

It will be observed that pins M1 and M7 of the microcomputer 60 are connected directly to ground 40, whereas reset pin M2 is connected to ground via a capacitor 68. In this way, the microcomputer 60 is reset each time the power is turned off and then turned on again. In other words, the momentary closure of the switch 30 initially supplies power to the microcomputer 60. It is up to the clock 62 to maintain power to the microcomputer 60, doing so through the agency of the transistor Q1 when biased into its conductive state (which can happen only when voice inputs occur within fifteen seconds of each other or when the switch 30 is again momentarily closed).

It is important to note from FIG. 3A that the output pin A7 of the operational amplifier **52*b* is connected to pin M8 (and pin M9) of the microcomputer 60. Inasmuch as pin M8 is connected to a timer contained within the microcomputer 60, the internally contained timer counts the zero-crossings in the electrical signals forwarded from the amplifier unit 32, after the voice signal from the microphone 28 has been amplified by the operational amplifiers 52*a*, 52*b***.

More specifically, the speech signal is divided into two frequency bands. Considering the first band to embrace a range of frequencies from 300 to 1,000 Hz and the second band as including frequencies between 1,000 and 6,000 Hz, all that the internal timer need do is to count the number of zero-crossings. If the number corresponds to the band of frequencies mentioned in the lower range, then the spoken word is recognized as a "yes", whereas if the count corresponds to the frequencies contained in the second band, then the count falling into this band is interpreted as a "no".

Because of its internally contained timer, the HD6805 microcomputer 60 admirably serves the function of determining or distinguishing between the words "yes" and "no". It will be appreciated that the timer contained in the microcomputer 60 allows the external input from the unit 32 to be used to decrement the internal timer circuitry. In this regard, it can be mentioned that the timer includes a counter which is loaded under program control, counting down toward zero as soon as a clock input is received from the unit 32, more specifically from the output pin A7 of its second stage **52*b***.

Actually, all that need be appreciated is that the microcomputer 60, through the agency of its internally contained timer, counts the zero voltage crossings within a short interval of time. It has already been stated that there is a lower band of frequencies that represents a "yes" and a higher band that represents a "no". If the count is below a threshold count, then the count represents a "yes" and the specific count that is derived will signify what group of words should be spoken by the doll 10 through the agency of the synthesizer unit 36, as will become clearer hereinafter. The same thing holds true with respect to a count representative of the higher frequency band because it will signify a "no", calling for a different phrase stored in a different portion of the synthesizer's memory.

Thus, it should be evident there is no absolute need for a recognition of each and every word that a child may speak. All that is required is that there be a recognition of a word resembling "yes" (by reason of the band of frequencies representative of "yes" and a count indicative of such band) or a recognition of higher frequencies associated with a corresponding higher count which provides a different set of phrases (by virtue of the higher frequency band being indicative of a word resembling "no").

Consequently, it will be understood that the microcomputer 60 recognizes certain formant characteristics contained in the voice picked up by the microphone 28 and forwarded to the internal timer located within the microcomputer 60, entering by way of its pin M8.

At this time, it will be explained that pins M33–M38 have six input/output lines AL1–AL6 connected thereto, the digital states of which determine an address for memory stored in the synthesizer unit 36. More specifically, the lines AL1–AL6 extend from the pins M33–M38 to the phrase selection input pins S1, S2, S4, S5, S7 and S8 of the synthesizer 36, the pins S1, S2, S4, S5, S7 and S8 being connected to a six line to sixty-four line decoder within the synthesizer unit 36. The decoder contained in the synthesizer unit 36 connects with a group of registers, in this instance sixty-four in that the storage of at least sixty-three bytes or words is planned. In other words, the binary output on the lines AL1–AL6 connecting the pins M33–M38 to the pins S1, S2, S4, S5, S7 and S8 can be varied in accordance with whatever signal is inputted to the microcomputer 60 via its pin M8 and the resulting count at which the timer ceases counting the zero voltage crossings.

As with the microcomputer 60, the synthesizer unit 36 can assume a variety of specific circuit configurations. In this instance, an integrated circuit chip manufactured by Hitachi has been found suitable, the specific model being designated as HD61886. While this integrated circuit chip contains a considerable amount of internal ROM memory (sixty-four registers), it can be pointed out that the chip can have connected thereto an external ROM memory if desired or needed. The particular model just mentioned will store sixty-three words that may be called out in any order by the microcomputer 60, more specifically, by reason of the specific binary output appearing on the pins M33–M38. In other words, the microcomputer 60 calls for a sequence of a variable number of words or phrases that are to be amplified and emitted through the speaker 38.

Stated somewhat differently, the binary values appearing on the pins M33–M38 constitute a digital code that simply calls for a particular word, the digital code being transmitted over the lines AL1–AL6 connected between the pins M33–M38 and the pins S1, S2, S4, S5, S7 and S8 of the synthesizer 36. As can be appreciated from the data sheets published by Hitachi, Ltd. the speech synthesis chip provides a linear filter, excitation generation, circuit for receiving and analyzing inputted digital data supplied from the microcomputer's pins M33–M38, appropriate timing circuitry being triggered into action by signals forwarded from the pins M25–M28, M39 and M40 of the microcomputer 60. In this way, synthesized human speech can be stored in the ROM memory of the synthesizer 36 and intelligible voice sounds reproduced as a result of the code signals forwarded from the microcomputer 60.

Described more specifically, the lines DL1–DL3 extending from the pins M26–M28 to the pins S40, S14 and S15 constitute handshake lines. In this regard, pin S40 is a so-called utterance signal pin, pin S14 an utterance start pin, and S15 a ROM output control pin. Thus, line DL1 extending from the pin M26 to the pin S40 tells the voice synthesizer 36 not to output any words. Line DL2 extending from the pin M27 to the pin S14 signals the synthesizer 36 to start outputting a string of words from one of 246 phrases ordered from the microcomputer 60 as determined by the digital signals appearing on the pins M33–M38 which pins are connected to the pins S1, S2, S4, S5, S7 and S8 by the lines AL1–AL6. By means of pin M28 and line DL4, the synthesizer 36 is electrically inactivated or shut down when nothing is transpiring, that is, when the doll 10 is in a quiescent state for a sufficiently long period.

It will be noted that pin S16 of the synthesizer 36 is held at plus voltage Vcc, being connected to the cathode of the diode 64, as are the pins A8 and M4. The internally contained digital/analog converter of the synthesizer unit 36 is connected to D/A output pin S31 and ground pin S33. The output pin S31 of the synthesizer 36 is connected to the input terminal QA3 of a second amplifier unit 132 which can include second dual operational amplifier of the HA17458 type. The pin designations, being the same, carry the same reference designations A1–A8 as used for the unit 32. In this case, however, the unit 132 functions as a lowpass filter, amplifying and filtering the synthesized voice signal outputted from the synthesizer 36 via its pins S31 and S33.

As far as pins S25 and S26 are concerned, these constitute terminals to which an oscillator 70 is connected. The oscillator 70 via the pins S25, S26 determines the rate of speech produced by the synthesizer unit 36, that is, how fast the words are spoken and hence the pitch of the words provided by the speaker 38.

The amplified voice signal on the output pin A7 of the unit 132 is delivered to an operational amplifier 72, such as the power amplifier TBA800, manufactured by SGS Semiconductor Corp., Waltham, Mass. The power amplifier 72 has input pins P8, P9 and P10, the low level filtered output signal from the pin A7 of the second operational amplifier unit 132 being impressed on these three pins P8–P10 via a coupling capacitor 74. Voltage supply pins P1 and P3 are connected directly to the emitter of the transistor Q1 so as to apply plus voltage Vcc from the battery 22 to the operational amplifier 70 whenever the clock 62 is turned on. As is evident, the pins P5–P7 are capacitor-biased to Vss ground 58. Pins P4 and P12 output the synthesized voice at a nominal one watt level to the speaker 38 which is coupled to the amplifier 72 via a capacitor 74. In this way, the voice sounds inputted to the circuit 20 via the microphone 28 produce desired output voice sounds from the speaker 38.

It must be borne in mind that in analyzing any given part of the words or phrases to be spoken by the doll 10 via the speaker 38, a great deal of redundancy is usually found, particularly where relatively simple phonetically pronounced phrases are selected. By examining the word bit by bit, it has been found that many side-by-side bits are identical and may be reduced with either a frame fill system of a variable frame rate with little or no degradation of speech quality. This means that the synthesizer unit 36 can have 32K bit registers, and still be capable of providing up to twenty-six seconds of actual speech. On the basis that the average word is one-half second, a forty-five word vocabulary is then rendered possible. Consequently, single chips with an on-board ROM memory are easily capable of twenty to forty words, being in a relatively low price range. Hence, it is only when a larger number of words are to be stored and reproduced upon call from the microcomputer 60 that an external ROM memory need be considered.

It has already been explained that the acceleration responsive switch 30 turns on or activates the microcomputer 60 when the doll 10 is picked up. It has also been mentioned that as long as there is a voice input by way of the microphone 28, the microcomputer 60 will stay turned on. The same thing holds true even if there is no voice input if the doll 10 is moved so that the acceleration responsive switch 30 is again momentarily closed. The microcomputer 60 will remain active as long as there is any voice input, that is, someone nearby either talking or singing to it (or if just plain noise if the right frequency strikes the microphone 28).

The microcomputer 60 is programmed to keep itself energized as long as signals are delivered to its pin M8. If no signals are received at pin M8, the microcomputer 60 will remain on for fifteen seconds, its software then turning it off so that the acceleration switch 30 must again be momentarily closed in order to reactivate the circuitry 20.

One feature of the invention is that once the microcomputer 60 has been turned on by reason of the acceleration switch 30 being closed, the microcomputer 60 will randomly call from ROM bank "A" (see FIG. 4) any of eleven different phrases of from one to four words. Thus, the doll 10, in effect, will initiate a conversation if the child does not say something during the initial period of several seconds which the doll 10 waits for before drawing from the words stored in bank "A" of the ROM memory. Of course, if there is a voice sound inputted via the microphone 28, such as a positive "yes", a negative "no" or just a general sound, the microcomputer 60 will call for the appropriate bank of random phrases as shown in the memory map appearing in FIG. 4. If a "yes", "no" or general statement is directly followed by continuous conversation, the phrase call out will be delayed until the sound input stops. After the system speaks and it is asked "what" the last phrase will be repeated. Any statement said to the doll 10 other than "what" will call for a randomly selected phrase from ROM bank "B" or ROM bank "C", the randomly picked phrase being spoken by the doll 10. Phrases from bank "A" of the ROM memory are only spoken by the doll 10 when it is first picked up. It is believed that FIG. 4, constituting a memory map, adequately apprises the reader of the various voice possibilities that are easily obtainable when practicing my invention. Coupled with the flow diagram of FIG. 5, the benefits to be derived from a practicing of my invention should be fully appreciated. It is to be noted that in FIG. 5, the "output" is what the doll 10 says, and the "input" is what the child says to the doll 10.

Consequently, it should be evident that a doll 10 utilizing the teachings of my invention will indeed be very realistic with respect to its two-way conversation with the child. In summary, if the doll 10 is picked up, the acceleration switch 30, being of the inertia type, energizes the microcomputer 60 so that it is conditioned for a voice input by way of the pin M8. On the other hand, if after several seconds there is no voice input, then the doll 10 initiates a voice output derived from ROM bank "A" which constitutes eleven different phrases that can be randomly drawn upon. If the doll 10 hears a sound corresponding to "what" then the last phrase will be repeated. Any statement that is made to the doll 10 other than something constituting or representing "what" will require that a randomly selected phrase be taken from either ROM bank "B" or "C" which will be outputted in the form of a voice signal from the speaker 38.

In general, the doll 10 has a bank of "X" number of phrases it says when picked up, "Y" number of phrases it says when it "hears" a "yes" (cross-overs indicative of a yes) from the child, and "Z" number of phrases the doll 10 says when it "hears a "no" (cross-overs indicative of a no) from the child. For a given desired voice quality, the total number of words the doll 10 says is dependent on the particular voice synthesis chip and memory bank constituting the synthesis unit that is used. The total number and selection of phrases that can be called out for given inputs, such as "yes", "no" and "what" is dependent, of course, on the particular microcomputer that is used.

Referring again to the memory map of FIG. 4, when the child picks up the doll 10, the doll says one of eleven phrases stored in ROM bank "A". When the child says "yes", the doll 10 responds from one of the 136 phrases contained in bank "B". When the child says "no", the doll 10 responds from one of the 126 random phrases stored in bank "C". On the other hand, when the child conducts a general conversation with the doll 10 without any "yes" or "no" appearing in the conversation, the doll responds from one of the 246 random phrases. Still further, when the child says "what", the doll 10 responds by repeating the previous phrase it has said. Thus, in a specific instance, there will be 126 "yes" responses, 110 "no" responses and 16 "yes" and "no" responses.

It may be well to set forth a "vocabulary" of sounds relating to the input-output responses from which a myriad of phrases can be formed such a list is as follows:

| | |
|---|---|
| 1. a | 24. mommy |
| 2. are, our (same sound) | 25. my |
| 3. been | 26. no |
| 4. but | 27. oh |
| 5. by, bye | 28. please |
| 6. comb | 29. play |
| 7. cookie | 30. pretty |
| 8. dress, dressing | 31. stay |
| 9. drink, drinking | 32. sing, singing |
| 10. go, going | 33. story |
| 11. good, goody | 34. there, their |
| 12. guess | 35. to, too, two (same sound) |
| 13. hair, hear, here (same sound) | 36. tell |
| 14. have | 37. yes |
| 15. hug | 38. you |
| 16. how | 39. want |
| 17. I | 40. we |
| 18. I'm | 41. what |
| 19. is | 42. where |
| 20. lets | 43. why |
| 21. like | 44. will |
| 22. love | 45. ing |
| 23. me | |

From the above vocabulary, the following eleven phrases (bank "A") can be said by the doll 10 when it is picked up;

1. Hug me, mommy.
2. Oh comb my hair, mommy.
3. I want a cookie.
4. Where have you been?
5. I love you, mommy.
6. Let's go bye-bye.
7. I want a drink.

8. Tell me a story.
9. Dress me, mommy.
10. Please hug me.
11. Oh, let's go, mommy!

If the child says "yes", "no" or "what" (causes last phrase to be repeated) or equivalent zero-crossing counts appear in general conversation, the doll 10 can utter any of a relatively large number of replies, too many (246) to list. However, a few can be given:

Child says "yes", doll 10 says:
1. I want a drink.
2. I want to you to hug me.
3. I want to sing.
4. I love to go bye-bye.
5. I like my dress.

Child says "no", doll 10 says:
1. I have pretty shoes.
2. I like to.
3. I want to know.
4. I will go, mommy.
5. Oh, please stay.

A few phrases the doll 10 says in response to either a "yes" or "no" are:
1. I love you, mommy.
2. I will, mommy.
3. Oh, hug me please.
4. Do we have to, mommy?
5. Tell a story.

As already indicated, when the child says "what" (or the equivalent is counted), then the doll 10 repeats the phrase it has just spoken.

Having presented the foregoing vocabulary and possible formatives derivable therefrom, it should be noted that the invention results in a highly "intelligent" doll 10—one possessing a vast amount of cooperative variety and intrigue.

I claim:

1. A talk back doll or toy figure comprising a microphone, a speech recognition unit connected to said microphone responsive to a predetermined band of frequencies contained in speech signals from said microphone, a battery, a normally open acceleration switch for actuating said speech recognition unit when said switch is momentarily closed by movement of said toy figure to condition said speech recognition unit for reception of speech-derived signals from said microphone, a speech synthesis unit controlled by said speech recognition unit for producing output signals representative of various preselected words in general accordance with said predetermined band of frequencies contained in said speech-derived signals, and speaker means connected to said speech synthesis unit for producing voice sounds derived from said output signals and containing therein a phrase composed of some of said preselected words.

2. A talk back doll or toy figure in accordance with claim 1 in which said speech synthesis unit includes means for storing various digital values representative of said preselected words.

3. A talk back doll or toy figure in accordance with claim 2 in which said speech recognition unit includes means for selecting certain of said digital values stored in said speech synthesis unit in accordance with said predetermined band of frequencies contained in said speech-derived signals to produce a meaningful phrase composed of some of said preselected words.

4. A talk back doll or toy figure in accordance with claim 3 in which said speech synthesis unit includes means for converting said certain digital values that have been selected in accordance with said speech-derived signals to analog output signals, said voice sounds being derived from said analog output signals.

5. A talk back doll or toy figure in accordance with claim 4 in which said speech synthesis unit includes an oscillator for determining the frequency of said analog output signals and hence the pitch of the voice sounds produced by said speaker means.

6. A talk back doll or toy figure in accordance with claim 1 in which said recognition unit includes means therein for continuing the actuation of said recognition unit once said acceleration switch has been momentarily closed and has returned to its normally open condition.

7. A talk back doll or toy figure in accordance with claim 6 in which said recognition unit includes means therein for inactivating said recognition unit after a predetermined time has elapsed in absence of any speech-derived signal.

8. A talk back doll or toy figure in accordance with claim 7 in which said recognition unit includes means therein for inactivating said recognition unit after a predetermined time has elapsed after cessation of speech-derived signal.

9. A talk back doll or toy figure in accordance with claim 1 in which said recognition unit includes means for continuing the actuation of said recognition unit as long as speech-derived signals are being received, and means for inactivating said recognition unit after a predetermined time has elapsed after the cessation of input signals.

10. A talk back doll or toy figure comprising a microphone, filter means connected to said microphone for providing electrical signals representative of various voice sounds picked up by said microphone, means for counting the number of zero-crossings in said electrical signals, means controlled by said counting means for providing a digital value indicative of certain input voice sounds picked up by said microphone, means for storing digital values indicative of preselected output voice sounds, means connected said storing means to said controlled means for causing said storing means to provide digital values in general accordance with the number of zero-crossings counted by said counting means, a speaker, and means for forwarding analog signals to said speaker derived from said digital values representative of the number of counted zero-crossings, whereby said speaker emits output voice sounds in general accordance with the number of counted zero-crossings and hence in response to the input voice sounds picked up by said microphone.

11. A talk back doll or toy figure in accordance with claim 10 including means for causing said storing means to randomly provide various digital values representative of a given number of zero-crossings.

12. A talk back doll or toy figure in accordance with claim 11 including means for causing said responsive means to provide certain digital values when said counting means has failed to count a certain number of zero-crossings during a predetermined interval of time.

13. A talk back doll or toy figure in accordance with claim 12 in which said number of zero-crossings equal zero in order to cause said responsive means to provide said certain digital values.

14. A talk back doll or toy figure in accordance with claim 13 in which said predetermined interval of time is on the order of three seconds.

15. A talk back doll or toy figure in accordance with claim 13 including means for rendering said storing means ineffectual when there are no zero-crossings counted for a second predetermined interval of time longer than said first predetermined interval of time.

16. A talk back doll or toy figure in accordance with claim 15 in which said first predetermined interval of time is on the order of three seconds and said second predetermined interval of time is on the order of fifteen seconds.

17. A talk back doll or toy figure in accordance with claim 16 including an acceleration switch for initiating said first and second time intervals.

18. A talk back doll or toy figure comprising first, second and third memory banks, each bank digitally storing data representative of selected words from which phrases are to be formed, means for initially accessing said first memory bank to read out data stored therein and thereafter accessing either said second or third memory banks to read out data stored therein, and means for generating voice sounds from the data read out from said first memory bank and thereafter from said second or third memory banks, said voice sounds containing a phrase composed of words derived from the digitally stored data of the particular memory bank being accessed.

19. A talk back doll or toy figure in accordance with claim 18 including a microphone, a battery, a switch, and means controlled by said switch for causing said accessing means to first access said first memory bank.

20. A talk back doll or toy figure in accordance with claim 19 including means controlled by electric signals derived from said microphone for causing said accessing means to access said second or third memory banks in accordance with the sound picked up by said microphone.

21. A talk back doll or toy figure in accordance with claim 20 in which said means controlled by said microphone will cause said accessing means to access said second or third memory banks without first accessing said first memory bank when said microphone picks up a sound within a predetermined interval of time.

22. A talk back doll or toy figure in accordance with claim 21 including means for inactivating said accessing means within a longer predetermined interval of time in the absence of any sound picked up by said microphone.

23. A talk back doll or toy figure comprising a microphone, a microcomputer connected to said microphone for providing first and second digital values in general accordance with two different voice sounds striking said microphone, means providing a first plurality of voice sounds in general accordance with said first set of digital values, and means providing a second plurality of voice sounds in general accordance with said second set of digital values.

24. A talk back doll or toy figure in accordance with claim 23 including an acceleration switch for supplying operating power to said microcomputer when said acceleration switch is momentarily closed.

25. A talk back doll or toy figure in accordance with claim 24 in which said microcomputer includes means therein for continuing the supply of power thereto after said acceleration switch has been momentarily closed and has reopened.

26. A talk back doll or toy figure in accordance with claim 25 in which said means for continuing the supply of power to said microcomputer does so for only a first interval of time after said switch has been closed or after a second interval of time after said microphone has received a voice sound.

27. A talk back doll or toy figure in accordance with claim 26 in which said microcomputer includes a timer for counting the zero-crossings in the electrical signals derived from said microphone, the count of the zero-crossings in a first instance being representative of one of said two different voice sounds and the count of the zero-crossings in a second instance being representative of the other of said two different voice sounds.

28. A talk back doll or toy figure in accordance with claim 27 in which said microcomputer includes first means for providing a digital output signal generally representative of the number of zero-crossings that have been counted in said first instance and second means for providing a digital output signal generally representative of the number of zero-crossings that have been counted in said second instance, said respective means for providing said digital output signals forwarding said digital output signals to said means for providing said plurality of voice sounds being responsive to the respective digital values of said output signals.

29. A talk back doll or toy figure in accordance with claim 28 in which said first-mentioned plurality of output signals is provided in response to a voice sound resembling the word "yes" and said different plurality of output signals as provided in response to a voice sound resembling the word "no".

30. A talk back doll or toy figure in accordance with claim 31 including means for causing words derived from either said first, second or third plurality of output signals to be repeated when said microphone receives a voice sound resembling the word "what".

31. A talk back doll or toy figure comprising a microphone, a speech recognition unit connected to said microphone including means responsive to a first predetermined band of frequencies contained in speech signals from said microphone, a battery, switch means in circuit with said battery for actuating said speech recognition unit to condition said speech recognition unit for reception of speech derived signals from said microphone, a speech synthesis unit including first means controlled by said speech recognition unit for producing output signals representative of various preselected words in general accordance with said first predetermined band of frequencies contained in said speech-derived signals, and speaker means connected to said speech synthesis unit for producing voice sounds derived from said output signals and containing therein a phrase composed of some of said preselected words.

32. A talk back doll or toy figure in accordance with claim 31 in which said speech recognition unit includes second means responsive to a second predetermined band of frequencies contained in speech signals from said microphone, and in which said speech synthesis unit includes second means controlled by said speech recognition unit for producing different output signals representative of various different preselected words in accordance with said second predetermined band of frequencies contained in said speech derived signals, said speaker means also producing voice sounds derived from said different output signals and containing therein a phrase composed of some of said different preselected words.

33. A talk back doll or toy figure comprising a microphone, a speech recognition unit including a microcomputer connected to said microphone, a battery, an acceleration switch for momentarily supplying power from said battery to said microcomputer, a clock connected to said microcomputer, said microcomputer starting said clock to run when power is momentarily supplied to said microcomputer, a transistor controlled by said clock, said clock causing said transistor to be conductive while said clock is running to continue the supply of power from said battery to said microcomputer for a predetermined period in the absence of an electrical signal from said microphone to said microcomputer, a speech synthesis unit connected to said microcomputer, and a speaker connected to said speech synthesis unit for producing speech signals in general accordance with the signals from said microphone to said microcomputer as determined by said speech synthesis unit.

34. A talk back doll or toy figure in accordance with claim 33 in which said speech synthesis unit is in circuit with said transistor and said transistor also supplies power to said speech synthesis unit when said transistor is conductive.

35. A talk back doll or toy figure in accordance with claim 33 in which said speech synthesis unit includes oscillator means for determining the frequency or said speech signals.

36. A talk back doll or toy figure in accordance with claim 35 including first amplifier means connected between said microphone and said microcomputer, and second amplifier means connected between said speech synthesis unit and said speaker, said first and second amplifier means also being in circuit with said transistor and said transistor also supplies power to said first and second amplifier means when said transistor is conductive.

37. A talk back doll or toy figure in accordance with claim 33 in which said acceleration switch includes a tubular casing, a ball, a resilient contact connected to said battery and a fixed contact connected to said microcomputer, movement of said doll or figure causing said ball to cause said resilient movable contact to engage said fixed contact and thus momentarily supply power from said battery to said microcomputer.

38. A talk back doll or toy figure in accordance with claim 37 in which said transistor includes a collector, emitter and base, said collector being connected to said battery and to said movable contact, said emitter being connected to said microcomputer and said base being connected to said clock, said counter causing said base to render said transistor conductive while said clock is running.

39. A talk back doll or toy figure comprising a normally open switch, speaker means, first means for storing signals representative of a first bank of words, second means for storing signals representative of a second and different bank of words, and means responsive to closure of said switch for causing said speaker means to emit a voice sound containing a phrase composed initially of several words derived randomly and in sequence only from said first bank of words.

40. A talk back doll or toy figure in accordance with claim 39 including a microphone, and means responsive to sounds of one frequency picked up by said microphone for causing said speaker means to emit a second voice sound containing a phrase composed of words derived from said second and different bank of words.

41. A talk back doll or toy figure in accordance with claim 40 including still another means for storing signals representative of a third and still different bank of words, and means responsive to sounds of a different frequency picked up by said microphone for causing said speaker means to emit a third voice sound containing a phrase derived from said third and still different bank of words.

42. A talk back doll or toy figure comprising a normally open switch, speaker means, means for storing signals representative of a bank of words, and means responsive to closure of said switch for causing said speaker means after a predetermined period of time to emit a voice sound containing a phrase composed of several words derived from said bank of words.

43. A talk back doll or toy figure in accordance with claim 42 including additional means for storing signals representative of a different bank of words, a microphone, and means responsive to sounds of one frequency picked up by said microphone before said predetermined period has elapsed for causing said speaker means to emit a voice sound containing a phrase composed of words derived from said different bank of words, the absence of sounds of said one frequency during said predetermined period of time allowing said speaker means to emit said voice sound.

44. A talk back doll or toy figure in accordance with claim 43 including still another means for storing signals representative of a still different bank of words, means responsive to sounds of a different frequency picked up by said microphone for causing said speaker means to emit a voice sound containing a phrase derived from said still different bank of words, the absence of sounds of either said one frequency and said different frequency allowing said speaker means to emit said voice sound.

45. A talk back doll or toy figure in accordance with claim 42 in which said switch is an acceleration switch comprised of a casing fixedly attached to said toy figure, a first contact in the form of a resilient leaf spring contained in said casing, a second contact contained in said casing and engageable by said first contact, said first contact being normally spaced from second contact to provide the normally open condition of said acceleration switch, and a ball for striking said first contact to momentarily cause said first contact to engage said second contact.

46. A talk back doll or toy figure comprising means providing speech signals from two different frequency bands, one band being in a lower frequency range and the other band in a higher frequency range, first means for producing a first voice output when said speech signals are in said lower frequency range, and second means for producing a second voice output different from said first voice output when said speech signals are in said higher frequency range.

47. A talk back doll or toy figure in accordance with claim 46 including means for counting the number of zero-crossings of said speech signals, a lower count denoting said lower frequency band and a higher count denoting said lower frequency band and a higher count denoting said higher frequency band.

48. A talk back doll or toy figure in accordance with claim 47 in which said first means includes a first ROM memory and said second means includes a second ROM memory.

49. A talk back doll or toy figure in accordance with claim 48 in which said first output is randomly selected from said first ROM memory and said second voice output is randomly selected from said second ROM memory.

50. A talk back doll or toy figure in accordance with claim 46 including means for producing a third voice output in the absence of speech signals.

51. A talk back doll or toy figure in accordance with claim 50 including means for preventing the production of any of said first, second or third voice signals until said doll or toy figure has been moved.

52. A talk back doll or toy figure in accordance with claim 51 in which said preventing means includes an acceleration switch.

53. A talk back doll or toy figure comprising first means for storing signals capable of producing X number of phrases, second means for storing signals capable of producing Y number of phrases, third means for storing signals capable of producing Z number of phrases, means for providing sound signals of various frequencies including those equivalent to the words "yes" and "no", speaker means causing said first means to produce one of its X phrases via said speaker means, means responsive to frequencies corresponding to the word "yes" for causing said second means to produce one of its Y phrases via said speaker means, and means responsive to frequencies corresponding to the word "no" for causing said third means to produce one of its Z phrases via said speaker means.

54. A talk back doll or toy figure in accordance with claim 53 including means responsive to frequencies corresponding to the word "what" for causing the preceding phrase from either said second or said third means to be repeated.

* * * * *

UNITED STATES PATENT AND TRADEMARK OFFICE

CERTIFICATE OF CORRECTION

PATENT NO. : 4,799,171

DATED : January 17, 1989

INVENTOR(S) : Charles A. Cummings

It is certified that error appears in the above-identified patent and that said Letters Patent is hereby corrected as shown below:

Col. 1, line 33; "h." should be --- H. ---.

Col. 1, line 68; "rmains" should be --- remains ---.

Col. 2, line 66; "calld" should be --- called ---.

Col. 3, line 48; "monentarily" should be --- momentarily ---.

Col. 5, line 33; "descerned" should be --- discerned ---.

Col. 6, line 45; "suvbsequent" should be --- subsequent ---.

Col. 10, line 16; "QA3" should be --- OA3 ---.

Col. 10, line 58; "of" should be --- or ---.

Col. 13, line 33; "noted" should be --- obvious ---.

Col. 14, line 31; "of input" should be --- of speech-derived ---.

Col. 14, line 42; "connected" should be --- connecting ---.

Col. 16, line 30; "31" should be --- 29 ---.

Col. 17, line 23; "or" should be --- of ---.

Col. 17, line 36; after "resilient" insert --- movable ---.

UNITED STATES PATENT AND TRADEMARK OFFICE

CERTIFICATE OF CORRECTION

PATENT NO. : 4,799,171

DATED : January 17, 1989

INVENTOR(S) : Charles A. Cummings

It is certified that error appears in the above-identified patent and that said Letters Patent is hereby corrected as shown below:

Col. 18, lines 57 and 58; delete "and a higher count denoting said lower frequency band."

Signed and Sealed this

Twenty-second Day of August, 1989

*Attest:*

DONALD J. QUIGG

*Attesting Officer*

*Commissioner of Patents and Trademarks*